US010118271B2

(12) United States Patent
Huber

(10) Patent No.: US 10,118,271 B2
(45) Date of Patent: Nov. 6, 2018

(54) ALTERNATIVE BLOCKING

(71) Applicant: Rodenstock GmbH, Munich (DE)

(72) Inventor: Karl Huber, Regen (DE)

(73) Assignee: Rodenstock GmbH, Munich (DE)

( * ) Notice: Subject to any disclaimer, the term of this patent is extended or adjusted under 35 U.S.C. 154(b) by 0 days.

(21) Appl. No.: 15/125,149

(22) PCT Filed: Mar. 11, 2015

(86) PCT No.: PCT/EP2015/000540
§ 371 (c)(1),
(2) Date: Sep. 10, 2016

(87) PCT Pub. No.: WO2015/135651
PCT Pub. Date: Sep. 17, 2015

(65) Prior Publication Data

US 2016/0375540 A1 Dec. 29, 2016

(30) Foreign Application Priority Data

Mar. 12, 2014 (DE) ..... 10 2014 003 539

(51) Int. Cl.
*B24B 13/005* (2006.01)
*B24B 13/02* (2006.01)

(52) U.S. Cl.
CPC ..... *B24B 13/005* (2013.01); *B24B 13/02* (2013.01); *B24B 13/0055* (2013.01)

(58) Field of Classification Search
CPC ... B24B 9/146; B24B 13/005; B24B 13/0055; B29D 11/00942
See application file for complete search history.

(56) References Cited

U.S. PATENT DOCUMENTS

| | | | | |
|---|---|---|---|---|
| 2,879,632 A | | 3/1959 | Allen et al. | |
| 3,866,667 A | * | 2/1975 | Knight | B23Q 1/54 164/334 |
| 4,277,916 A | | 7/1981 | Buhler | |
| 5,005,633 A | * | 4/1991 | Mathews | B23Q 1/54 164/334 |
| 5,150,547 A | | 9/1992 | Johnson | |
| 6,855,036 B1 | | 2/2005 | Arserio et al. | |

FOREIGN PATENT DOCUMENTS

| | | |
|---|---|---|
| DE | 2458307 A1 | 6/1975 |
| WO | WO-2014013072 A1 | 1/2014 |

OTHER PUBLICATIONS

European Patent Office, International Search Report issued for PCT/EP2015/000540 dated Jul. 23, 2015, 3 pgs. (German language only).

* cited by examiner

*Primary Examiner* — Timothy V Eley
(74) *Attorney, Agent, or Firm* — Schiff Hardin LLP

(57) ABSTRACT

Device for blocking a spectacle lens blank that has a finished surface and a machining surface, situated opposite the finished surface, for machining in a machining device. The device includes a receiving component having a convex, planar or concave receiving surface for blocking the finished surface of the spectacle lens blank, wherein the receiving component has an essentially flat counter-surface that is arranged opposite the receiving surface, and wherein the normal of the counter-surface is inclined by 1° to 10° counter to the normal at the middle point of the receiving surface.

18 Claims, 3 Drawing Sheets

ALTERNATIVE BLOCKING

Figure 1:
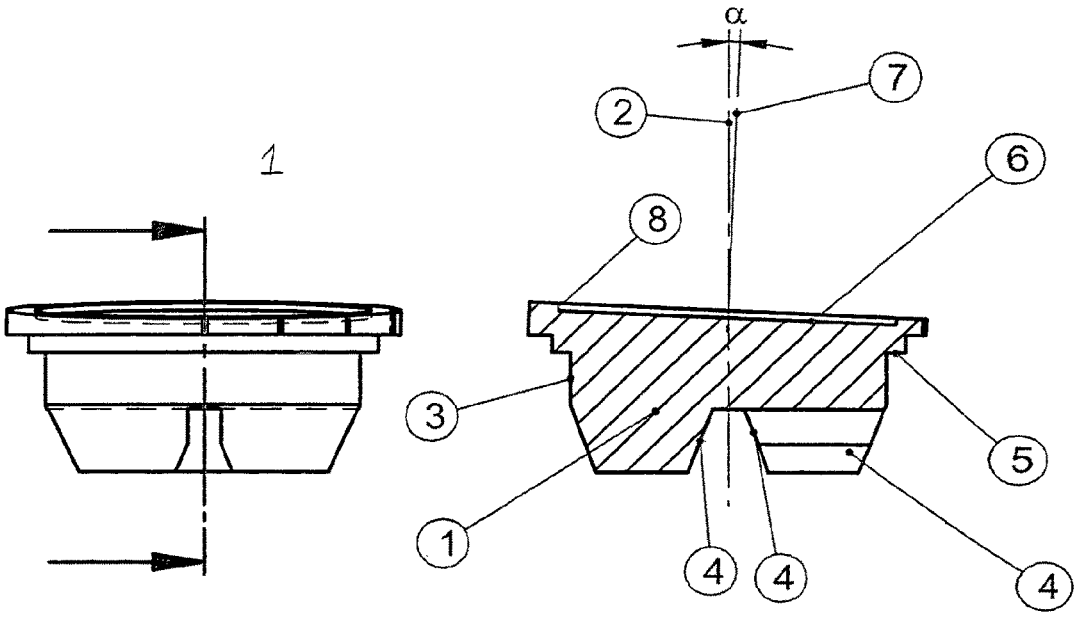

The invention concerns a device for blocking a spectacle lens blank, a method for blocking a spectacle lens blank, and the use of a device for blocking a spectacle lens blank.

To produce individually adapted spectacle lenses, a customer is refractioned—by an optician, for example—and customer parameters that are thereby measured are sent to a spectacle lens manufacturer. The spectacle lens manufacturer determines a matching spectacle lens blank (also called a blank) for this individual customer, which blank normally has an optical finished surface on the convex side, and calculates a matching rear surface for this spectacle lens blank that depends on the measured customer parameters and is called a prescription surface. The prescription surface may be a sphere, a torus, an asphere, an atorus or also a free-form surface.

In order to be able to clamp the spectacle lens blank in a correct position for a machining of the prescription surface in a machining device, the spectacle lens blank is typically connected via a blocking material with a block piece that can be clamped. This process is called blocking, wherein a block is formed from a block piece, a blocking material and a spectacle lens blank.

In the most common production method for manufacturing and machining the prescription surface, the block is clamped in the processing machine so that an axis of symmetry of the block (which is called block piece axis or machining axis) coincides with a work piece spindle axis of the machining device so that the spectacle lens blank may rotate around this axis during the machining. The prescription surface may thus be machined via milling, grinding and/or turning with spiral-shaped tool path. A singular point at which the spiral begins or ends hereby results precisely in the middle of the C-axis (the rotational axis or pivot axis).

If the finished spectacle lens should have a prism at this point, the spectacle lens blank is normally prismatically blocked. The finished surface of the spectacle lens blank is thereby mounted at an angle in relation to the block piece such that the surface normal of the prescription surface coincides with the block piece axis (and thus with the work piece spindle axis) only at a singular point. High dynamic requirements for the machine, and the errors that accompany these, are thereby avoided at this point.

The blocking of the spectacle lens blank normally takes place via positioning of the block piece in an inclined relation to the finished surface of the spectacle lens blank in a device that is also called a blocker. After both parts are positioned relative to one another, the essentially wedge-shaped intervening space is filled with liquid wax, plastic, UV-curing plastic or a metal alloy of low melting point as a blocking material and is cooled (or cured via UV light) until it solidifies. The spectacle lens blank and the block piece are thereby firmly connected with one another.

The disadvantage of this method is that this process introduces heat into the system, and the blocker material naturally shrinks due to the phase transition from liquid to solid. The spectacle lens blank is thereby deformed or is held in an imprecisely defined position, such that deviations from the desired optical properties result in the finished spectacle lens.

The blocking with alloy additionally has the disadvantage that the material has a high proportion of toxic heavy metals.

Furthermore, the lens is not fully supported during the processing. If non-round lenses result due to the prescription values, only the middle circular region of the spectacle lens blank—which is completely covered by the lens even in a finished, ground spectacle lens and whose middle coincides with the axis of rotation—can be supported by the blocking material. Outer regions that are larger in part thereby result in the block that are not supported during machining. As a result of this, cosmetic and optical defects arise, in particular in the edge regions of very thin lenses.

The invention is based on the object to enable an improved prismatic and/or fully supported blocking of a spectacle lens blank.

The invention is achieved via the subject matters of the independent claims.

One aspect concerns a device for blocking a spectacle lens blank that has a finished surface and a machining surface, situated opposite the finished surface, for machining in a machining device. The spectacle lens blank can be processed into a prismatic spectacle lens with the machining device. The device for blocking has a receiving component that has a convex, planar or concave receiving surface for blocking the finished surface of the spectacle lens blank. Since the finished surface is of convex shape in most spectacle lens blanks, the receiving surface for such spectacle lens blanks is concave in shape. For spectacle lens blanks having concave finished surfaces, the receiving component may have a convex receiving surface. For planar spectacle lens blanks, the receiving surface may also be planar in shape.

The receiving component has an essentially flat counter-surface that is arranged opposite the receiving surface. The normal of the counter-surface is thereby angled by 1° to 10°—preferably between 1° and 5° and particularly preferably between 2° and 3°—relative to the normal at the middle point of the receiving surface. The middle point of the receiving surface is thereby the intersection point (for example the piercing point) of the receiving surface with the normal of the counter-surface. The middle point of the receiving surface preferably lies on the axis of symmetry of a bearing component (see the embodiment further below).

The receiving component thus has an essentially wedge-shaped cross section, wherein one wedge side—namely the section through the receiving surface—is concave or convex in shape.

The wedge angle, or the inclination of the convex or concave receiving surface relative to the counter-surface, corresponds to the angle of the two surface normal. Given an essentially spherical shape of the receiving surface, the normal at the middle point of the receiving surface travels through the spherical circle center point.

The middle point of the receiving surface may be designed as that equilibrium support point at which the receiving surface may be borne with support in equilibrium if an arbitrarily constant, homogeneous surface density (for example in units of $kg/m^2$) is associated with the receiving surface. In this case, the equilibrium support point may lie precisely below, above or at the geometric center of gravity of the receiving surface.

The receiving surface may in particular be designed to receive a spherical finished surface of a spectacle lens blank in the form of a concave spherical calotte, thus as the curved part of a spherical segment. In this exemplary embodiment, the middle point of the receiving surface may be designed as the intersection point of the vertical on the middle point of the circular disc of the spherical segment with the receiving surface. The normal in the middle point of the receiving surface may coincide with this vertical.

The receiving surface is thereby precisely the surface part of the receiving component that is designed and provided to bear and support the spectacle lens blank, without possible edge regions.

Due to the forward inclination of the receiving surface by a receiving inclination angle β relative to the counter-surface, a receiving component with an inclination adapted to a prism to be produced in the spectacle lens may be used, such that—upon blocking—the spectacle lens blank may be placed with essentially its entire surface on the receiving surface. For example, a spectacle lens may have a prism in order to correct eye defects, or may be provided as a middle thickness reduction prism by means of which the thickness of the spectacle lens may be reduced.

The prismatic blocking of the spectacle lens blank is thereby improved: the necessary mass of blocking material, of which only a very thin layer is required on the receiving surface upon blocking the spectacle lens blank, is reduced via the full-surface placement of the spectacle lens blank on the placement surface. This reduces the effects on the alignment of the spectacle lens blank given a phase transition of the blocking material from liquid to solid, since deformations due to shrinkage are reduced. Given use of a blocking material containing heavy metals, the fumes are reduced due to the smaller mass of blocking material. A thin layer of blocking material can furthermore be more easily released from the finished spectacle lens. Cosmetic and optical defects on the spectacle lens are thereby avoided.

Furthermore, lower requirements exist for the rigidity of the blocking material than for a blocking material that needs to fill large volumes. This enables the use of blocking materials having lower rigidity.

In one embodiment, the device has a bearing component having an essentially flat and inclined bearing surface on which the receiving component can be borne with its counter-surface. The bearing surface of the bearing component is thereby inclined relative to a predetermined machining axis of the bearing component. The machining axis of the bearing component is, in good approximation, an axis of rotational symmetry of the bearing component and is designed and provided to coincide (in a machining position clamped in a machining device) with a work piece spindle axis (the C-axis) of the machining device. Upon machining, the bearing component may be rotated around the machining axis, wherein the entire block is rotated.

Not only the receiving component itself thus has an inclined counter-surface, but rather also the bearing component on which the receiving component is borne. The final inclination of the receiving surface for the spectacle lens blank therefore depends on both the inclination of the counter-surface and on the inclination of the bearing surface. Via the positioning of the counter-surface relative to the bearing surface, the inclination of the receiving surface therefore can be adjusted individually to the prism to be created for the spectacle lens.

In this embodiment, in a machining position the bearing surface may be formed inclined such that the normal in the middle point of the bearing surface is inclined by 1° to 10°—preferably between 1° and 5°, particularly preferably between 2° and 3°—relative to the machining axis of the machining device.

In one exemplary embodiment, the normal of the counter-surface is inclined by the same angle (namely the receiving inclination angle β) relative to the normal at the middle point of the receiving surface as the normal at the middle point of the bearing surface relative to the machining axis (namely by the bearing inclination angle β). For example, if both inclination angles amount to 2.5°, spectacle lens blanks having a prismatic angle of incidence between 0° and 5° may be blocked with the device.

In one embodiment, the receiving component and the bearing component are designed so as to be rotatable counter to one another, such that the normal in the middle point of the receiving surface is arranged parallel or at an incline relative to the machining axis in a machining position of the device, and wherein the magnitude of the inclination is dependent on the rotation position of the receiving component relative to the bearing component. Receiving component and bearing component are designed to be rotatable counter to one another. Depending on the rotation setting, the inclinations of the counter-surface and the bearing surface add up or they mutually cancel. The inclination angle of the bearing surface is thus adjustable via the rotation position of the two components relative to one another, and can be matched precisely to the prism to be produced. The rotation setting may thereby take place continuously or in individual locking steps. Locking elements for this may be formed on the bearing component and/or on the receiving component. If the two inclinations cancel one another in a rotation setting, a prism of 0 dpt may in particular also be set. In this special rotation setting, the normal of the receiving surface is formed to be collinear or coaxial with the machining axis.

In a development of this embodiment, in the machining position of the device an inclination angle between the normal in the middle point of the receiving surface relative to the machining axis of the bearing component of 0° to 20°—preferably between 0° and 10°, particularly preferably between 0° and 5°—can be set via the rotation position of the receiving component relative to the bearing component. The inclination angle of the receiving surface in the machining position of the device is thereby dependent on the inclinations of the counter-surface and the bearing surface.

According to one embodiment, the receiving component and the bearing component can be connected with one another positively or non-positively. For example, the connection may be established via elastic force, via bolting, hydraulically, pneumatically and/or via negative pressure. Corresponding connection means for this may be provided at the bearing component and/or at the receiving component. The connection may be releasable, such that at least the bearing component is reusable, whereas the receiving component may be designed as a consumable component.

According to one embodiment, the bearing component is designed as an independent, separate component. This enables a simple rotation of the receiving component counter to the bearing component to adjust the prismatic angle of incidence. In this embodiment, the device is designed in two parts.

In an alternative embodiment, the bearing surface of the bearing component is designed as an integral component of the machining device. In this embodiment, the receiving device designed as one part may be placed directly on the inclined bearing surface that, for example, may be formed in the lining of the machining device.

According to one embodiment, the receiving component is formed from an easily machinable material. For example, polystyrene or a metal (for example zinc or aluminum) may be used as an easily machinable material. The receiving component is preferably designed as an injection-molded part (made of polystyrene, for example) and thus can be produced cost-effectively. The spectacle lens blank may thereby be blocked over its entire surface on the receiving component, even if the finished spectacle lens should not have a circular shape. Upon machining of the spectacle lens blank, material is removed from the machinable receiving component together with the spectacle lens blank. This enables a support of the spectacle lens blank during the machining at all locations and improves the quality of the end product.

The device for blocking is therefore preferably designed and provided to be clamped in the same machining devices as previously known block pieces.

One aspect concerns a method for blocking a spectacle lens blank having a finished surface and a machining surface situated opposite the finished surface for machining in a machining device with which the spectacle lens blank can be processed into a prismatic spectacle lens, with the steps

- place an essentially flat counter-surface of a receiving component with a convex, planar or concave receiving surface on an essentially flat and inclined placement surface of a bearing component,
- rotation of the receiving component relative to the bearing component until the normal at the middle point of the receiving component is inclined at a predetermined angle relative to a predetermined machining axis of the bearing component, and
- blocking of a spectacle lens blank on the receiving surface.

Given this method, the spectacle lens blank may connected—via adhesive tape, via adhesion, via at least one chemically curable material, and/or via at least one material by means of a phase transition from liquid to solid—with the receiving surface of the receiving component via gluing so as to be releasable over its entire surface. For example, these materials may be used as blocking materials. Via the precise alignment of the placement surface on the predetermined prism, the distance between the receiving component (as part of the block piece) and the spectacle lens blank is reduced so that blocking materials may also be used that could not stably fill a voluminous intervening space (for example as was previously the case with a wax or adhesive containing heavy metal). Under the circumstances, the blocking may thus already take place by means of a double-sided adhesive tape. A blocking material that is largely free of heavy metal is preferably used for blocking.

According to one aspect, a device described above is used for implementation of the method.

Figure 2:
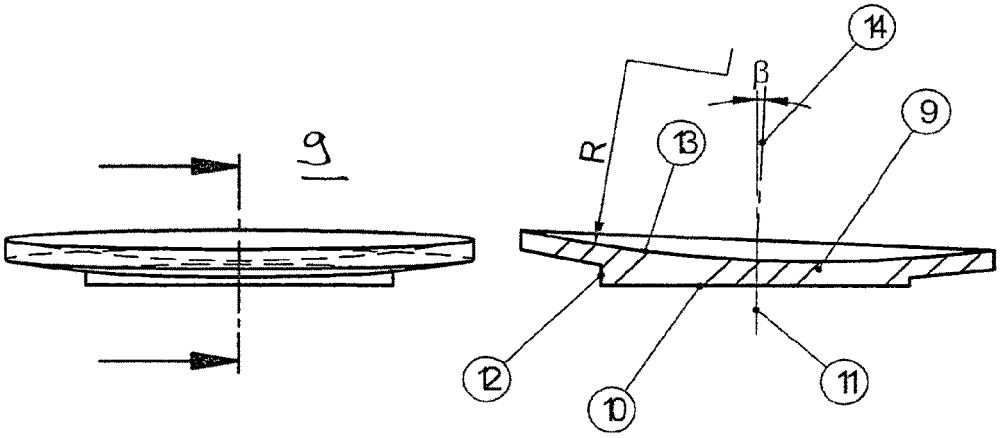
Figure 3:
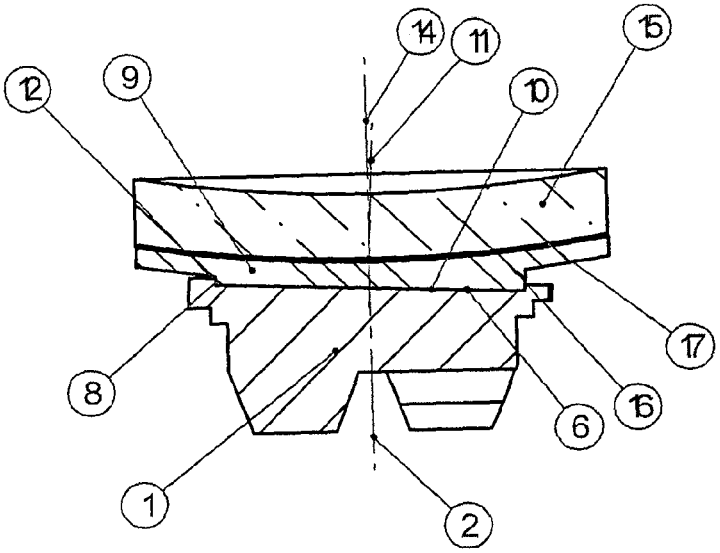
Figure 4:
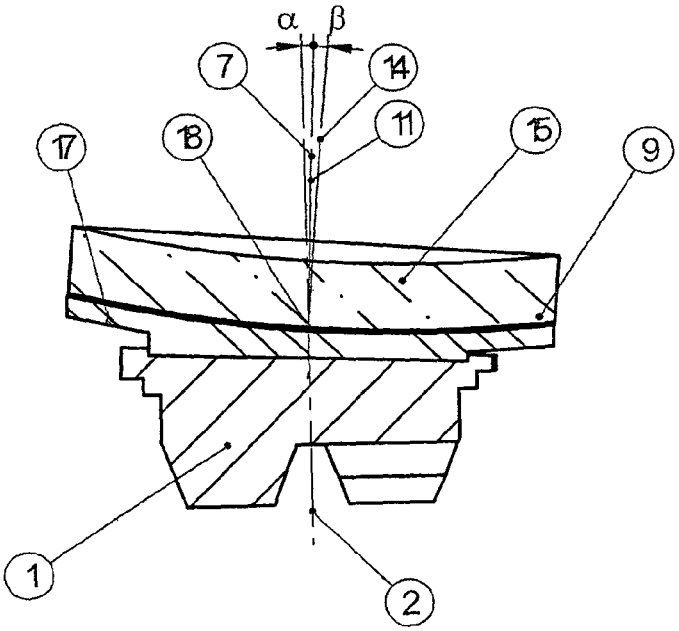
Figure 5:
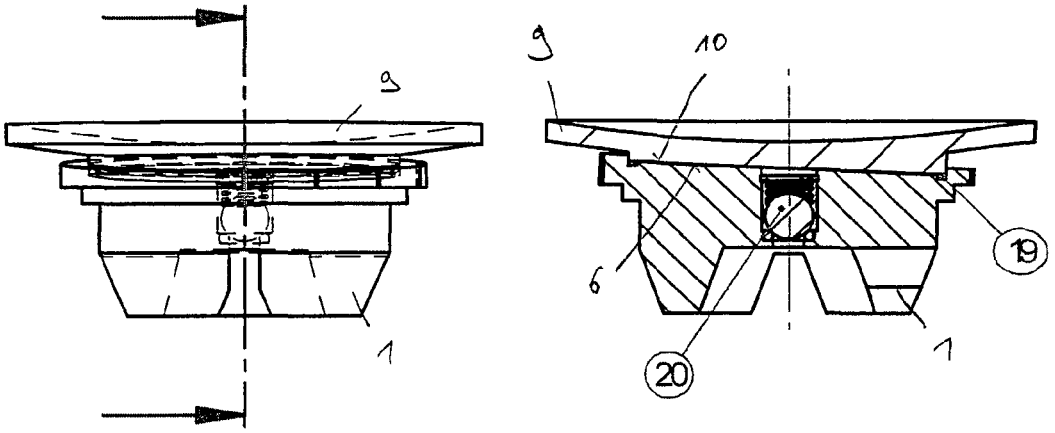

The invention is described in detail in the following using embodiments shown in Figures. Individual features of the exemplary embodiments shown in Figures may be transferred to other embodiments. Shown are:

FIG. 1 a bearing component in the form of a clamping block as part of a device for blocking a spectacle lens blank;

FIG. 2 a receiving component of a device for blocking a spectacle lens blank;

FIG. 3 a two-part device for blocking, together with a spectacle lens blank in whose prescription surface no prism is to be introduced;

FIG. 4 a two-part device for blocking, together with a spectacle lens blank in whose prescription surface a prism is to be introduced; and FIG. 5 a receiving component that is coupled to a bearing component by means of negative pressure.

FIG. 1 shows a clamping block 1 as an exemplary embodiment of a bearing component of a device for blocking. A side view of the clamping block 1 is thereby shown in the left half of FIG. 1, whereas the right half of FIG. 1 shows a cross sectional view through the clamping block 1.

The clamping block 1 is designed as a reusable bearing component. A central clamping block axis 2 through the clamping block 1 is designed and provided to serve as a predetermined machining axis of a spectacle lens blank. The clamping block 1 may be clamped in a machining device (not shown in Figures) so that the clamping block 1 is located in its machining position. The clamping block 1 is essentially cylindrical and is designed to be essentially rotationally symmetrical relative to the clamping block axis 2 as seen from a surface inclination (which is described in detail in the following). The clamping block axis 2—thus the machining axis of the clamping block 1 as a bearing part—may, in the machining position, coincide with a work piece spindle axis of the machining device.

The clamping block 1 furthermore has central alignment surfaces 3, rotary alignment surfaces 4 and axial alignment surfaces 5 that are respectively provided with regard to the central, rotational or axial alignment of the clamping block 1 in the machining device, relative to a tool spindle of the machining device.

The central alignment surfaces 3 are thereby formed parallel to the clamping block axis 2 and are designed as a cylindrical shell of the clamping block 1. The cylinder end of the clamping block 1 (which is designed and provided to be clamped in the machining device) leads, after the cylinder shell formed by the central alignment surfaces 3, into three feet that taper in the direction of the clamp-side cylinder end of the clamping block 1. These tapering surfaces of the three feet are formed by the rotary alignment surfaces 4. The other cylinder end of the clamping block 1 that is situated on the opposite side from the clamp-side cylinder end is designed and provided to receive a spectacle lens blank via a receiving component (see FIG. 2). At this receiving-side cylinder end of the clamping block 1, the cylinder shell that is formed by the central alignment surfaces 3 leads into an annular disc surface that is arranged orthogonal to the cylinder wall, which annular disc surface is formed by the axial alignment surfaces 5. At this location, the diameter of the cylindrical clamping block is expanded via the axial alignment surfaces 5. The axial alignment surfaces 5 are formed orthogonal to the machining axis, thus the clamping block axis 2.

A bearing surface inclined by a bearing inclination angle $\alpha$ relative to the clamping block axis 2 borders the clamping block 1 at its receiver-side cylinder end. The bearing surface 6 is designed to be essentially flat and essentially disc-shaped. The middle point of the disc is arranged near the machining axis 2. The middle point of the disc should be offset from the machining axis 2 so that the rotation point of the receiving surface comes to lie on the machining axis. The bearing surface 6 is furthermore designed to be inclined so that the normal 7 of the bearing surface 6 is inclined by the bearing inclination angle $\alpha$ relative to the clamping block axis 2. The normal of the bearing surface 6 is shown as a bearing axis 7 in FIG. 2.

The bearing surface 6 is designed as a disc-shaped depression in the receiver-side cylinder end of the clamping block 1. The disc-shaped depression thus has a step-like elevation at its ring ends. The walls of this elevation are formed, in the shape of a cylindrical shell, as bearing component centering surfaces 8, wherein the bearing component centering surfaces 8 are arranged parallel to the bearing axis 7.

FIG. 2 shows a receiving component 9 that is designed as a blank receiver or spectacle lens blank receiver. A side view of the receiving component 9 is thereby shown in the left half of FIG. 1, whereas the right half of FIG. 2 shows a cross sectional view through the receiving component 9.

The receiving component 9 is essentially designed in the shape of a disc, wherein the disc surface is designed as a receiving surface 13 in the form of a bonding surface. The receiving surface 13 is concave and serves to receive and bear a finished surface of a spectacle lens blank upon blocking. For this, the receiving surface 13 largely has the counter-shape of the finished surface of a spectacle lens blank to be machined, which normally corresponds to a sphere.

The disc surface of the receiving component 9 that is situated opposite the receiving surface 13 is designed as an essentially flat and circular counter-surface 10. The normal 11 of the counter-surface 10 is inclined by a receiving inclination angle β relative to the normal 14 at the middle point of the receiving surface 13. The two normal 11 and 14 intersect in or near the intersection point of the normal 11 of the counter-surface 10 with the receiving surface 13.

The counter-surface 10 is set off like a step from the remaining body of the receiving component 9. Receiving component centering surfaces 12 in the shape of a cylindrical shell are formed on the step, which receiving component centering surfaces 12 are designed parallel to the normal 11 of the counter-surface 10.

The receiving component 9 shown in FIG. 2 and the clamping block 1 shown in FIG. 1 are designed and provided to be used as a two-part device for blocking. The two components are assembled for this, as this is shown in FIGS. 3 and 4.

In a cross section through a block, FIG. 3 shows the clamping block 1 and the receiving component 9 in a state in which they are assembled and connected to one another. A spectacle lens blank 15 is arranged and blocked on the receiving surface 13 of the receiving component 9.

In an assembled state, the counter-surface 10 of the receiving component 9 lies with its entire surface on and in parallel with the bearing surface 6 of the clamping block 1. The normal 11 of the counter-surface 10 and the clamping block axis 2 as the machining axis are thereby arranged directly atop one another. For this, the bearing surface 6 is centered on the counter-surface 10 by means of the receiving component centering surfaces 12 and the bearing component centering surfaces 8. The bearing component centering surfaces 8 thereby surround the receiving component centering surfaces 12. For this, the cylinder radius of the cylindrical bearing component centering surfaces 8 is adapted to the cylinder radius of the cylindrical receiving component centering surfaces 12 and/or vice versa.

The prism necessary for the machining may be adjusted via a rotation of the two components (receiving component 9 and clamping block 1) relative to one another. The inclination of the normal 14 of the receiving component 13 relative to the clamping block axis 2 is thereby dependent on the rotation position of the receiving component 9 relative to the clamping block 1. The inclination of the blocked spectacle lens blank 15 relative to the clamping block axis 2 is therefore also dependent on this relative rotation position.

The clamping block 1 and the receiving component 9 are connected with one another positively or non-positively to form a block piece unit, so as to be releasable. The positive or non-positive connection may take place via elastic force, bolting, hydraulically, pneumatically or via negative pressure.

The spectacle lens blank 15, with its finished surface 16 on the receiving surface 13 of the receiving component 9, is blocked via gluing, via adhesive tape, via adhesion, via chemically curable materials and/or via materials with phase transition from liquid to solid as a blocking material 17. This takes place after the receiving component 9 and the clamping block 1 have been set precisely on the prism to be produced via rotation movement counter to one another and have been fastened to one another. Therefore, for blocking it is sufficient to join—via a relatively thin layer—blocking material 17 with either a partial surface or over its entire surface with the receiving component 9 so as to be releasable.

Due to the use of a thin layer of blocking material 17, the heat introduction or the shrinkage upon curing of the blocking material 17 is so slight that no noteworthy deformations occur in the alignment of the spectacle lens blank 15.

For this, the two components of the device for blocking may preferably be designed so that the normal 14 of the receiving surface 13, the clamping block axis 2 and the finished surface 16 of the spectacle lens blank 15 have a common intersection point 18 (see FIG. 4).

Furthermore, the bearing inclination angle α between the clamping block axis 2 and the bearing axis 7 of the clamping block 1 may be made identical to the receiving inclination angle β between the normal 11 of the counter-surface and the normal 14 of the receiving surface 13. In this embodiment, a prism of 0 dpt results if the clamping block axis 2 coincides with the normal 14 of the receiving surface 13 and the angles α and β mutually cancel (see FIG. 3).

In this embodiment, the maximum prism that can be set—which corresponds to the sum of bearing inclination angle α and receiving inclination angle β (see FIG. 4)—results via a rotation of the receiving component 9 relative to the clamping block 1 by 180° out of this position. Any prism angle may be set with discrete stepping or continuously via rotation between the two positions.

Analogous to FIG. 3, FIG. 4 shows the block made up of clamping block 1, receiving component 9 and spectacle lens blank 15. In contrast to the relative position that is shown in FIG. 3, the clamping block 1 and receiving component 9 are thereby rotated counter to one another so that the normal 14 of the receiving surface 13 is aligned at an incline counter to the machining axis 2 at the maximum adjustable inclination angle α+β, and the maximum prism for the processing is thus set.

The unit made up of clamping block 1, receiving component 9 and spectacle lens blank 15 provides a block. By means of the clamping block 1, the block may be centered, axial and aligned in terms of its rotation position in a machining device (not shown). Furthermore, the machining forces may be transferred from the clamping chuck of the machine to the block. The prescription surface of the spectacle lens blank 15 and the lens positions necessary for the production of the lens (from the customer data (for example engraving positions)) are adapted to the rotation position of the resulting prism basis corresponding to the rotation of the receiving component 9 relative to the clamping block 1.

The receiving component 9 may be comprised of a machinable material that is not environmentally harmful. The spectacle lens blank 15 is machined during the production of the prescription surface and/or of the outer contour. If the geometry of the spectacle lens to be produced requires it, the receiving component 9 that is joined with the spectacle lens blank 15 is also partially machined. Following this, the prescription surface is polished to a finish. If applicable, the outer contour of the spectacle lens blank 15 is only produced after the polishing. This has the advantage that the spectacle lens blank 15 may be polished away largely without edge defects since the polishing tool is supported by the receiving component 9 and is not tilted away over the lens edge.

After finishing the prescription surface (and if applicable the outer contour), the spectacle lens is released from the receiving component 9 and supplied to possible additional refining steps.

In an alternative embodiment, the clamping block 1 is omitted. In this embodiment, the bearing surface 6, the bearing axis 7 and the bearing component centering surface 8 are designed as components of the work piece spindle of the machining device.

FIG. 5 shows a two-part device for blocking. A side view of the device is thereby shown in the left half of FIG. 5, whereas the right half of FIG. 5 shows a cross section through the device.

FIG. 5 shows an embodiment of a two-part device for blocking in which the receiving component 9 is attached to the clamping block 1 non-positively by means of negative pressure so as to be releasable. After the inclination angle of the prism has been set via the rotation movement described above, the intervening space between the clamping block 1 and the receiving component 9 is bounded by a seal 19 and evacuated via a valve 20. The external overpressure then presses the counter-surface 10 and the bearing surface 6 onto one another and thus ensures the position of the two components of the device relative to one another via frictional engagement.

REFERENCE LIST

1 clamping block; bearing component
2 clamping block axis; machining axis
3 central alignment surface
4 rotational alignment surface
5 axial alignment surface
6 bearing surface
7 bearing axis
8 bearing component centering surface
9 receiving component
10 counter-surface
11 normal of the counter-surface
12 receiving component centering surface
13 receiving surface
14 normal at the middle point of the receiving surface
15 spectacle lens blank
16 finished surface
17 blocking material
18 intersection point
19 seal
20 valve
$\alpha$ bearing inclination angle
$\beta$ receiving inclination angle

The invention claimed is:

1. A device for blocking a spectacle lens blank that has a finished surface and a machining surface, situated opposite the finished surface, for machining in a machining device, with the device comprising:

a receiver having a convex, planar or concave receiving surface configured to block the finished surface of the spectacle lens blank such that an entire surface of the spectacle lens blank is joined with the receiving surface of the receiver, wherein the receiver has an essentially flat counter-surface that is arranged opposite the receiving surface, wherein the normal of the counter-surface is inclined by 1° to 10° counter to the normal at the middle point of the receiving surface.

2. The device according to claim 1, further comprising:

a bearer having an essentially flat and inclined bearing surface relative to a machining axis of the bearer on which the receiver, which has a counter-surface, can be borne.

3. The device according to claim 2, wherein the bearing surface is inclined in a machining position so that the normal of the bearing surface is inclined by 1° to 10° relative to the predetermined machining axis of the bearer.

4. The device according to claim 3, wherein the receiver and the bearer are designed to be rotatable counter to one another so that the normal at the middle point of the receiving surface is arranged to be parallel with or at an incline relative to the machining axis of the bearer, and wherein a magnitude of the incline depends on a rotation position of the receiver relative to the bearer.

5. The device according to claim 4, wherein an inclination angle between the normal at the middle point of the receiving surface relative to the machining axis can be set from 0° to 20° via the rotation position of the receiver relative to the bearer.

6. The device according to claim 2, wherein the normal of the counter-surface is inclined by the same angle, counter to the normal at the middle point of the receiving surface, as the normal of the bearing surface relative to the machining axis of the bearer.

7. The device according to claim 2, wherein the receiver and the bearer are joinable with one another positively or non-positively.

8. The device according to claim 2, wherein the bearer is designed as a separate component.

9. The device according to claim 2, wherein the bearing surface of the bearer is designed as an integral component of the machining device.

10. The device according to claim 1, wherein the receiver is made of an easily machinable material.

11. The device according to claim 1, wherein the receiver is designed in the form of a concave spherical calotte.

12. The device according to claim 1, wherein, upon blocking the spectacle lens blank, the spectacle lens blank is machined by removing material from the receiver and the spectacle lens blank at the same time.

13. The device according to claim 1, wherein the normal at the middle point of the receiving surface, a machining axis of the bearer, and a finished surface of the spectacle lens blank have a common intersection point.

14. The device according to claim 1, wherein the spectacle lens blank is joined with the receiving surface of the receiver so as to be releasable, via gluing, adhesive tape, adhesion, at least one chemically curable material or via at least one material by means of a phase transition from liquid to solid.

15. A method for blocking a spectacle lens blank that has a finished surface and a machining surface, situated opposite the finished surface, for machining in a machining device, the method comprising:

placing an essentially flat counter-surface of a receiver having a convex, planar or concave receiving surface onto an essentially flat and inclined bearing surface of a bearer, rotating the receiver relative to the bearer until the normal at the middle point of the receiving surface is inclined to be at an angle ($\alpha+\beta$) relative to a machining axis of the bearer, and blocking a spectacle lens blank on the receiving surface such that, upon blocking the spectacle lens blank, an entire surface of the spectacle lens blank is joined with the receiving surface of the receiver.

16. The method according to claim 15, wherein the spectacle lens blank is joined with the receiving surface of the receiver so as to be releasable, via gluing, adhesive tape, adhesion, at least one chemically curable material or via at least one material by means of a phase transition from liquid to solid.

17. The method according to claim 15, further comprising:

machining the spectacle lens blank by removing material from the receiver and the spectacle lens blank at the same time.

18. The method according to claim 15, wherein the normal at the middle point of the receiving surface, a machining axis of the bearer, and a finished surface of the spectacle lens blank have a common intersection point.

* * * * *